US006601492B1

(12) United States Patent
Schusheim

(10) Patent No.: US 6,601,492 B1
(45) Date of Patent: Aug. 5, 2003

(54) PUNCHING PRESS DEVICE FOR PUNCHING OPENINGS IN PROFILED BARS, AND METHOD OF PUNCHING

(75) Inventor: Asher Schusheim, Ramat-Gan (IL)

(73) Assignee: Shoham Machines and Dies Ltd. (IL)

( * ) Notice: Subject to any disclaimer, the term of this patent is extended or adjusted under 35 U.S.C. 154(b) by 0 days.

(21) Appl. No.: 09/889,547

(22) PCT Filed: Jan. 12, 2000

(86) PCT No.: PCT/IL00/00024

§ 371 (c)(1),
(2), (4) Date: Jul. 18, 2001

(87) PCT Pub. No.: WO00/41826

PCT Pub. Date: Jul. 20, 2000

(30) Foreign Application Priority Data

Jan. 18, 1999 (IL) ..... 128089

(51) Int. Cl.[7] ..... B23D 21/14
(52) U.S. Cl. ..... 83/195; 83/54
(58) Field of Search ..... 83/54, 50, 188, 83/184, 192, 193, 194, 698.11, 651.1

(56) References Cited

U.S. PATENT DOCUMENTS 1,503,551 A * 8/1924 Nice ..... 80/188
3,489,045 A 1/1970 Ray
4,744,276 A 5/1988 Duce
5,347,899 A 9/1994 Schultz et al.

FOREIGN PATENT DOCUMENTS

GB 2024690 1/1980

* cited by examiner

*Primary Examiner*—Paul T. Sewell
*Assistant Examiner*—M. Chambers
(74) *Attorney, Agent, or Firm*—Ostrolenk, Faber, Gerb & Soffen, LLP

(57) ABSTRACT

A method and devices are disclosed for punching one or more holes in extruded hollow profiled bars (50; 70; 270) where a back-up matrix (42; 150–550) must be inserted and located in precise alignment with the punching male punch (66; 90) die. Accordingly, the matrixes are mounted to portable mandrel rods (40; 140) provided with settable stop brackets (44; 146). The rods are placed in their exact operative punching position, and removed therefter for processing the next bar. The method further provides for simultaniously punching holes in more than one wall of the profiled bars.

8 Claims, 13 Drawing Sheets

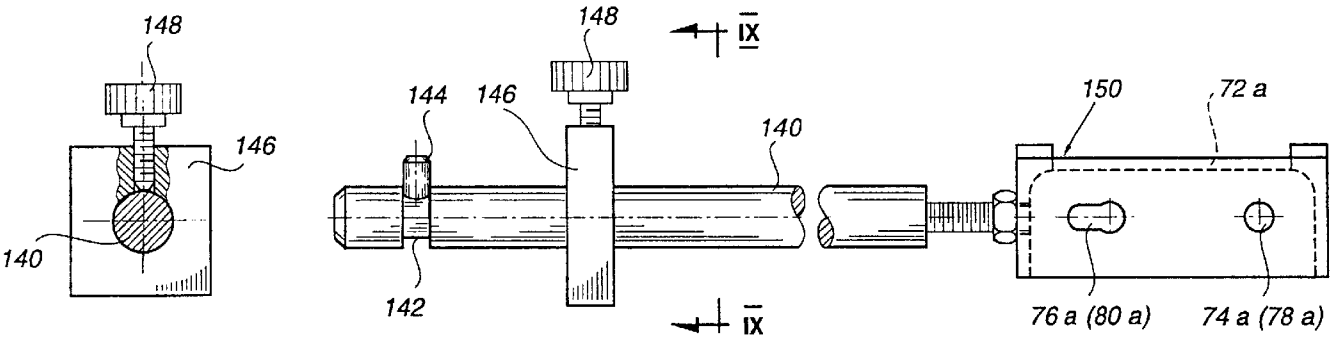
FIG. 9 a
FIG. 9 b
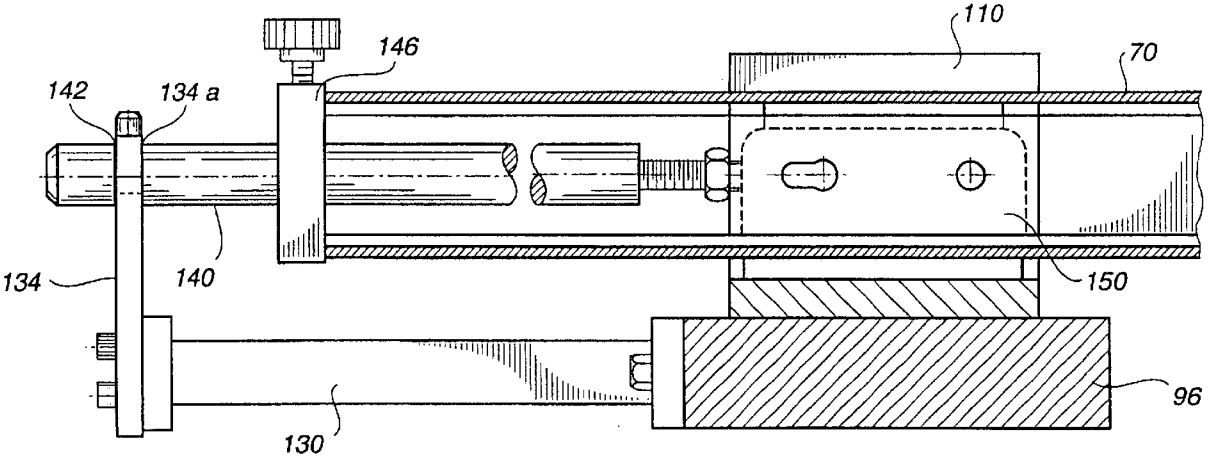
FIG. 11

PUNCHING PRESS DEVICE FOR PUNCHING OPENINGS IN PROFILED BARS, AND METHOD OF PUNCHING

FIELD OF THE INVENTION

The present invention relates to the art of punching openings in a workpiece and particularly to press devices for punching elongated, hollow profiled bars, mostly aluminum extruded bars, as used in the building industry for the construction of door and window frames.

BACKGROUND OF THE INVENTION

In order to better evaluate the contribution to the art of the present invention reference shall be made to FIGS. 1*a*–1*d,* schematically illustrating the traditional, state of the art technique of punching extruded bars. Hence, in FIG. 1*a* there is shown a punching press device generally denoted 10 of any known construction, namely usually provided with a pneumatic cylinder and piston unit 12, and male punch 14.

To base plate 16 of the device 10 there is connected a generally L-shaped extension bar 18 to which a mandrel rod 20 is fixedly connected (by bolts 22). The mandrel rod carries at its free end female punch die ("matrix") 24 with counter-opening 25 configured to back-up extruded profile 26 during the punching operation.

The mandrel rod 20 is provided with a fixable stop bracket 28 for setting the distance of the punched opening from the end of processed profiled bar 26.

It will be noted that the mandrel rod 20 is somewhat flexible and normally, when not in operation, it extends at a certain angle relative to the horizontal slanting in the direction of the punching press 10. However, when the extruded profiled bar 26 is dressed over the matrix 24 (FIG. 1*b*), the rod 20 becomes precisely aligned, namely slightly raised by the lower wall width W1 of the bar 26. This will ensure that the male punch 14 and the female back-up die are in exact vertical alignment with respect to each other to ensure a clean cut of the opening.

As evident from FIG. 1*c,* the horizontal alignment or location of the matrix 24 is ensured by a roller or the equivalent device 30 the location thereof again takes into account the side wall width W2 of the bar 26.

Now, these principles of construction and working process are common to existing punching presses as known now for decades.

These devices, however, suffer from numerous drawbacks. First, it is generally inconvenient and time-consuming to insert the sometimes quite long profiled bars 26 into the operative position of FIG. 1*b,* bearing in mind that only small tolerances must be left between the inner cross-section of the bar 26 and the outer shape of the female matrix 24.

Secondly, it is inconvenient to remove the stamped wall pieces of the processed bars from the opening 25 following one or several punching cycles.

Thirdly, due to the unaligned or tilted initial position of the mandrel rod 20, when not in use, it is recommended always to keep a piece of a profiled bar 26' over the matrix 24—see FIG. 1*d.* This precaution measure is taken to avoid damage to the male punch 14 and/or the matrix 24 if, unintentionally, the press 10 is operated while being in the position of FIG. 1*a,* namely when the matrix counter opening 25 is not in exact vertical register with the opening of the male punch 14.

Lastly, should the back-up opening (25) be located off-centrally (as exemplified in FIG. 1*c*), and it is required to have another opening be formed exactly oppositely, at the other wall of the bar (26), it is necessary to employ a separate, additional punching device (press and matrix).

A prior art device of the above mentioned kind is disclosed in Document U.S. Pat. No. 3,489,045 relating to a tube punching device for punching openings in profiled bars comprising a male punch and a female punching matrix for backing the bar during the punching operation wherein the punching matrix is attached to an elongate mandrel rod, the mounting constituted by the punching matrix and elongated mandrel rod being permanently mounted to a supporting frame and allowed only to carry out an up and down movement and a limited degree of movement from left to right. Therefore the mounting unit is not removable in operation from the supporting frame.

These and additional drawbacks of the existing punching press devices and method of operation are designed to be overcome by the contribution of the present invention.

It is thus the general object of the present invention to substitute the fixed mandrel rod and matrix structure by a portable or non-stationary mandrel bar.

It is a further object of the invention to provide punch press devices, utilizing the concept of non-stationary mandrel rod, for the application of punched openings at two or three walls of a processed extruded bar simultaneously.

SUMMARY OF THE INVENTION

Thus, there is provided according to a first aspect of the present invention a punching press device for punching openings in profiled bars comprising a male punch and a female punching matrix for backing the bar during the punching operation characterized in that the punching matrix is attached to an elongated rod removable from the punch device, means being provided for releasably placing the rod in a position suitable for punching an opening in the profiled bar by the male punch against the female punching matrix.

According to another aspect of the present invention there is provided a method of punching openings in profiled bars by punching press device comprising a male punch die and a female punching matrix, the method comprising the steps of mounting the female punching matrix to an elongated rod, inserting the matrix and a portion of the rod into the profiled bar; and placing the assembly of matrix and rod in a position suitable for punching the opening by the male punch.

The profiled bars may be hollow or non-hollow, as the case may be.

BRIEF DESCRIPTION OF THE DRAWINGS

These and further constructional features and advantages of the invention will become more clearly understood in the light of the ensuing description of preferred embodiments thereof, given by way of example only, with reference to the accompanying drawings, wherein

FIG. 9*a* is a side view of non-stationary mandrel rod applicable for processing the bar by the punch press of FIG. 4;

FIG. 9*b* is a partly sectional view taken along line IX—IX of FIG. 9*a;*

FIG. 11 shows the operational stage after the insertion of the mandrel rod and matrix into the position ready for punching by the punch press of FIG. 4;

DETAILED DESCRIPTION OF THE PREFERRED EMBODIMENTS

Figure 1A:
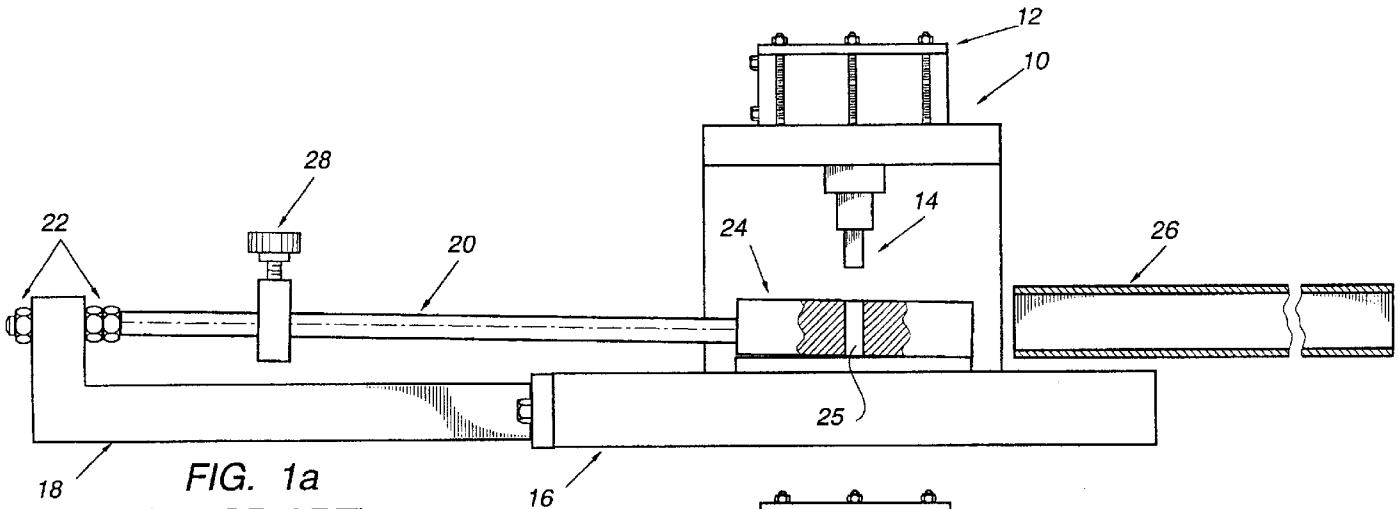
FIG. 1a (PRIOR ART)
FIGS. 1*a*–1*d* illustrate the prior art punching technique.
Figure 1B:
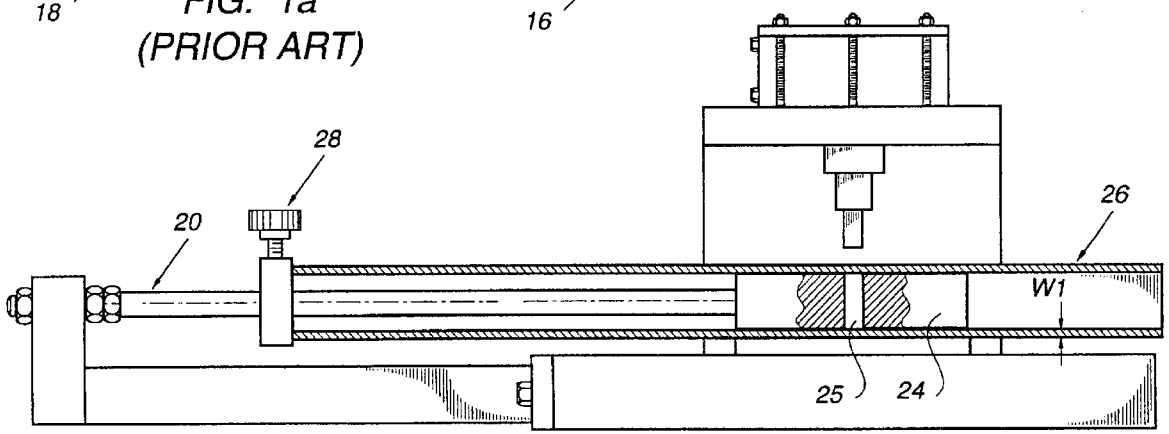
FIG. 1b (PRIOR ART)
Figure 1C:
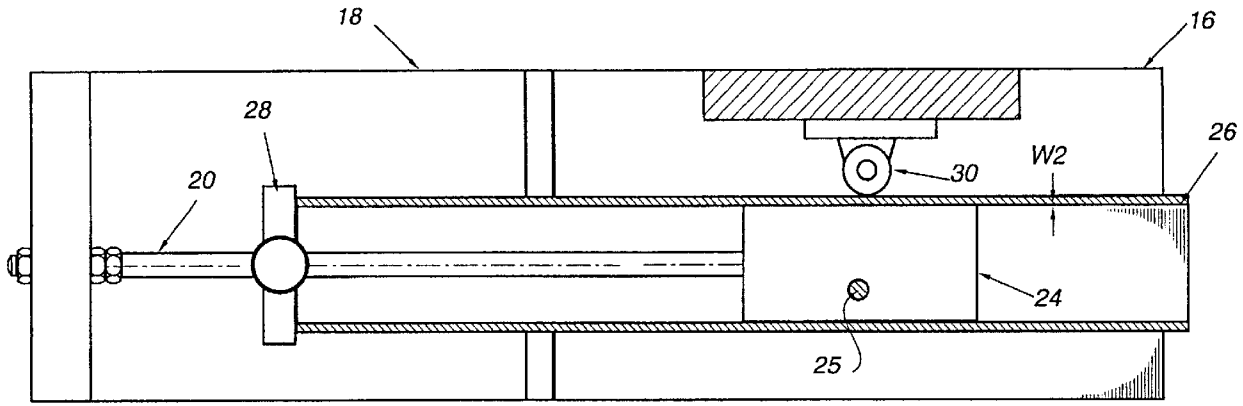
FIG. 1c (PRIOR ART)
Figure 1D:
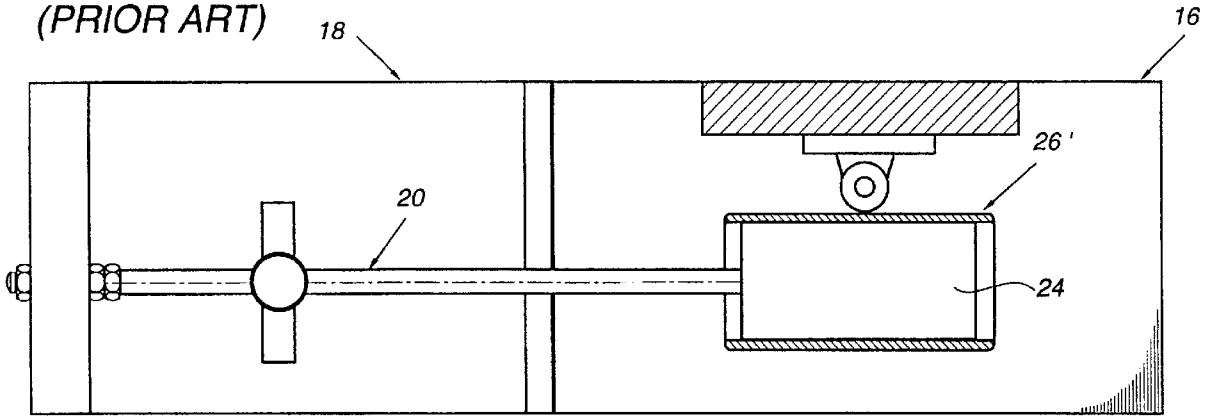
FIG. 1d (PRIOR ART)

Referring to FIGS. 2*a*–2*d* there are schematically illustrated the structural elements and practice of the punching method proposed according to the present invention. Thus, a removable mandrel rod 40 is provided, carrying matrix or female punch matrix 42 with punch hole 43 and adjustable stop bracket 44. It is formed as a stand-alone, portable unit to be used in the manner that will be explained below.

The matrix 42 is preferably hollow (see also FIG. 10 below) so that the removal of punched-out pieces is practically done by itself.

At the left-hand side of the rod 40 there is formed a circular recess 46, preferably with a vertical pointer pin 48.

Extruded bar 50 is to be processed, being for the sake of this general example of simple rectangular cross-section.

Figure 2A:
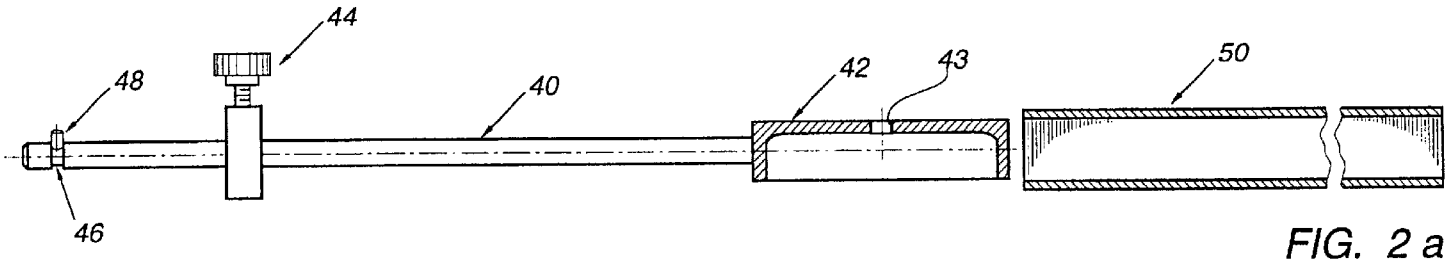
FIGS. 2*a*–2*d* schematically illustrate the implementation of the non-stationary mandrel rod concept and practice.
Figure 2B:
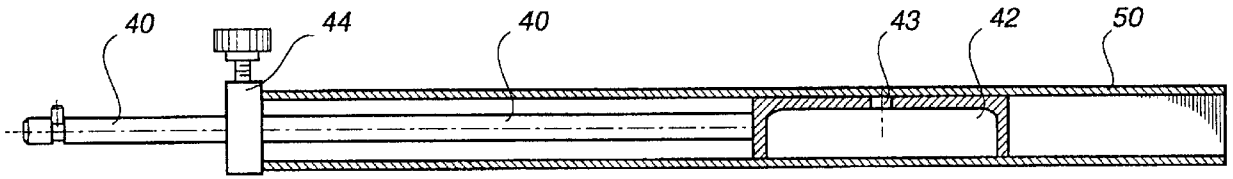

The first stage of operation is illustrated in FIG. 2*b,* where extruded bar 50 is dressed or passed over the female matrix 42, down to its abutting position against the stop bracket 44.

Figure 2C:
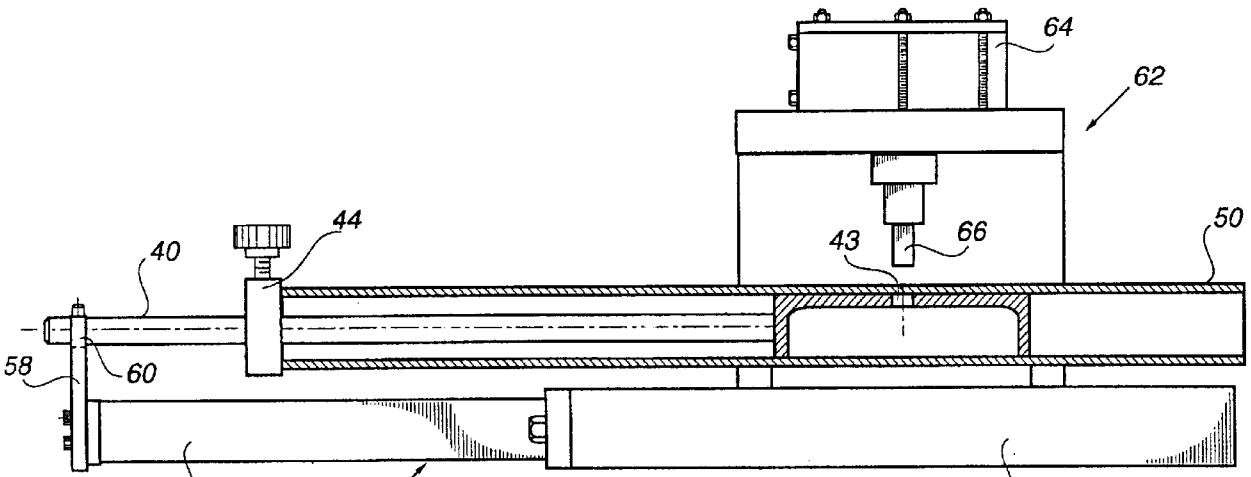
Figure 2D:
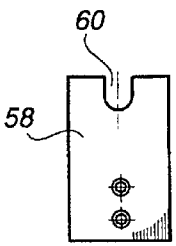

As shown in FIG. 2*c,* the assembly of bar 50 and mandrel rod 40 is placed on base plate 52 of punch press 62 (see below). The base plate 52 is extended by an L-shaped beam 54, the latter comprising support bar 56 and upright flat plate 58. A semi-circular recess 60 is formed at the plate 58 as shown in FIG. 2*d,* exactly fitting around the recess 46 of the bar 40.

The punching press device 62 may be of any conventional construction, namely comprising pneumatic cylinder and piston unit 64, and male punch 66. The distance between the punch back-up hole 43 and the recess 46 of the rod 40 is so designed as to achieve the requested precise vertical alignment of the hole 43 and male punch 66.

The punching operation proceeds as in the conventional devices, and thereafter the succession of the operations is reversed.

It will be appreciated at this stage that achieved are the advantages of

- more convenient practice in the insertion of the matrix 42 into the hollow of the bar 50—instead of the reverse procedure of dressing the bar over the matrix when the later is fixed to the base plate of the device; and
- removal of the residual stamped-out bar pieces from the hole 43 is achieved almost by itself, when the matrix 42 is separated from the bar 50.

Figure 3:
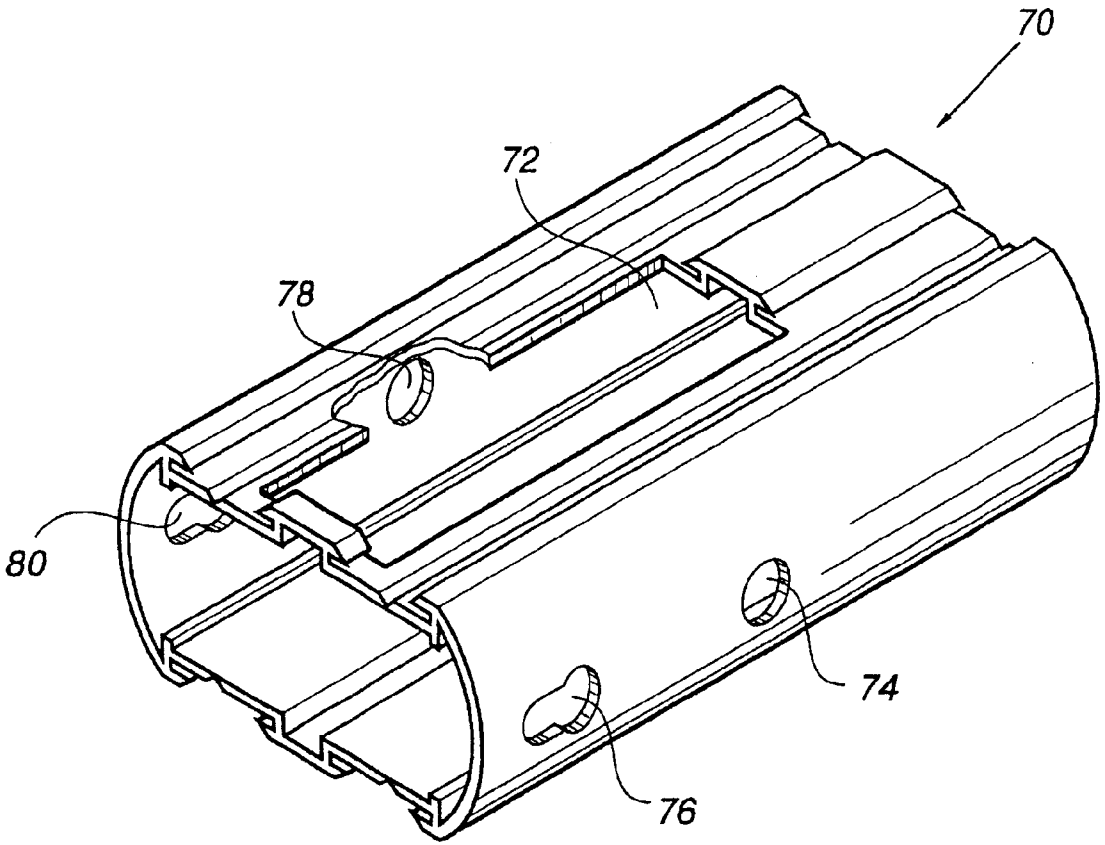
FIG. 3 illustrates a length of a profile for exemplifying the application of the invention with regard to forming openings at three sides thereof.

Additional valuable advantages of replacing the conventional fixed mandrel rod structure by the maneuverable mandrel rod technique as herein proposed would be better appreciated by the following, more advanced example of processing an extruded bar generally denoted 70 in FIG. 3, of the shape vastly used in the construction of doors made of profiled aluminum extruded bars. In this example bar 70 must be formed with

- a rectangular opening 72 at its top wall;
- a first, circular opening 74 and a second keyhole shaped opening 76 at one-side wall; and
- symmetrically opposite openings 78 and 80 at the other side wall of the bar 70.

These openings are used for installing the standard handle and cylinder lock mechanism of the doors. The precise opposite alignment is therefore of vital importance.

Figure 4:
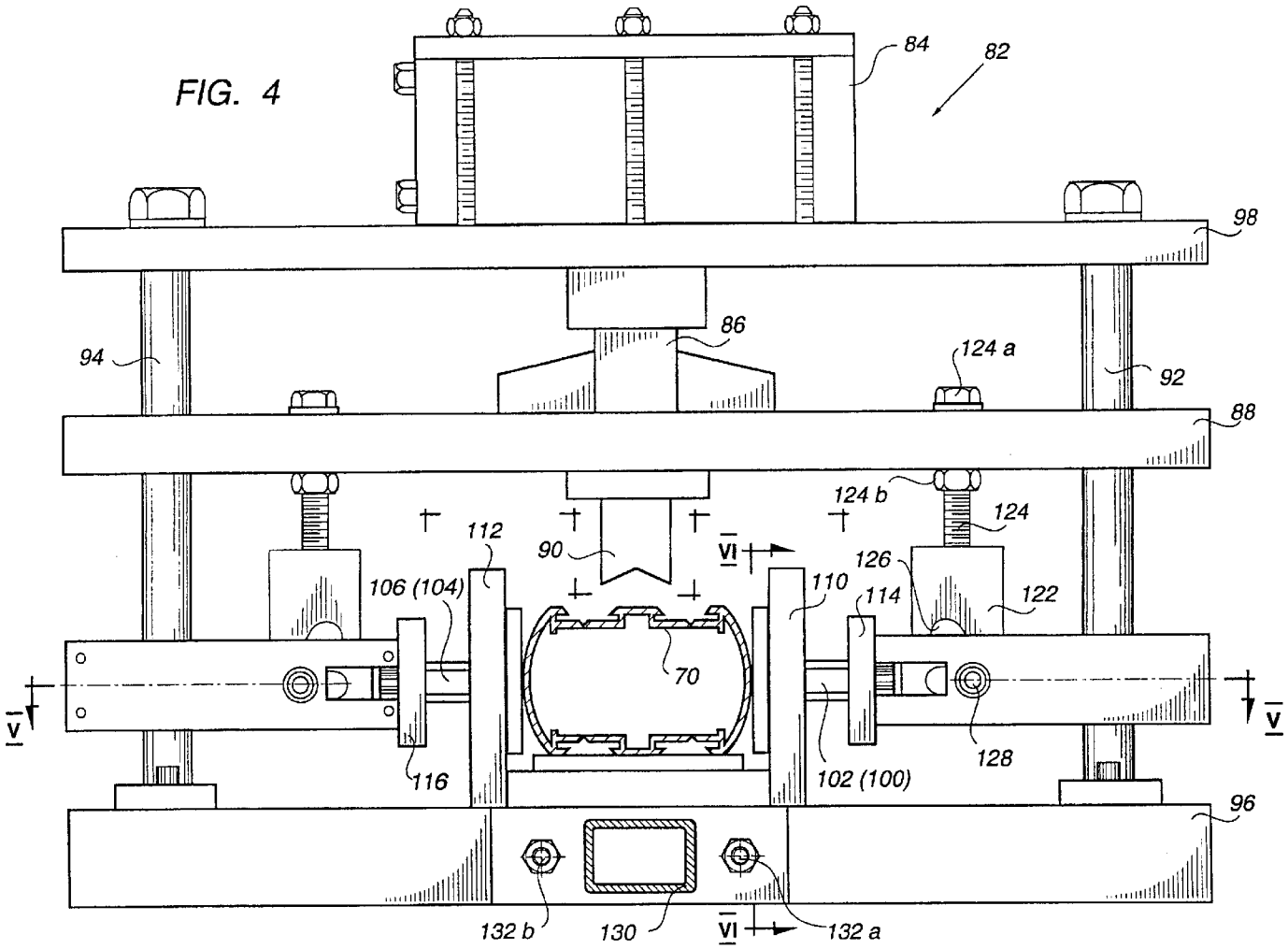
FIG. 4 is a schematic elevation of a punching press device for processing the bar of FIG. 3.

FIG. 4 schematically illustrates the construction of a press punch device useful for carrying out the operation of punching out the openings 72, 74, 76, 78 and 80 in a single high precision operation. Thus, punching press device 82 comprises a pneumatic cylinder unit 84 for operating piston rod 86 which causes the reciprocating movement of cross plate 88. This movement is transferred to male punch 90, suitably shaped for cutting the opening 72 of extruded bar 70, and also to a pair of side or lateral punches which will be Ad described in more detail further below.

Figure 5:
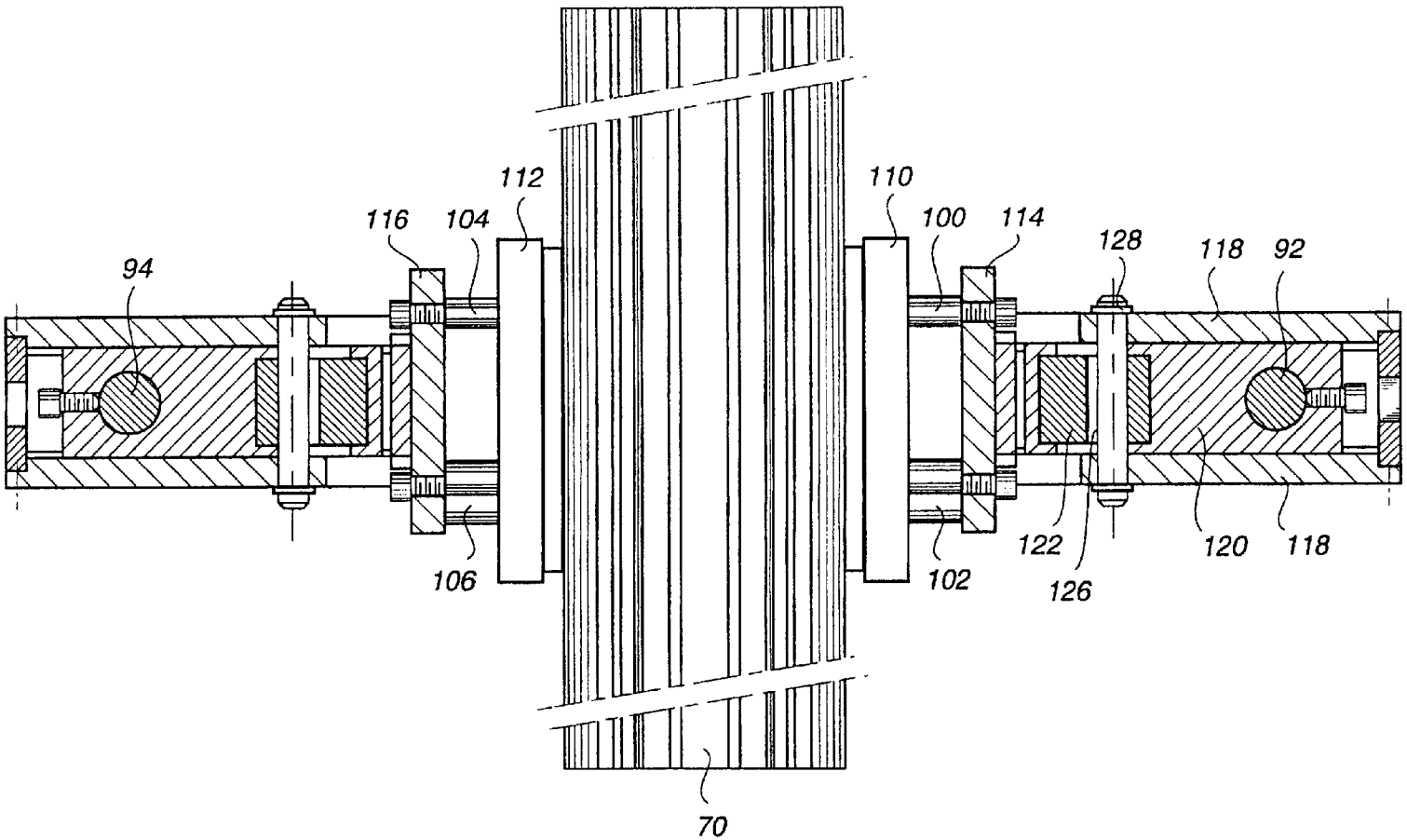
FIG. 5 is a sectional view along line V—V of FIG. 4.
Figure 6:
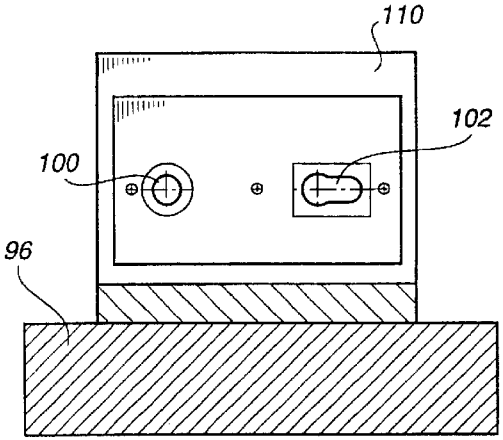
FIG. 6 is a view taken along line VI—VI of FIG. 4.

The reciprocable cross plate 88 is guided by pair of columns 92 and 94 which are affixed to base plate 96 at the bottom side and carrying top plate 98 at the other side. As better is seen in FIGS. 5 and 6, side punch 100 is designed to cut the opening 74; punch 102 punches out the opening 76; punch 104 punches the opening 78; and punch 106—opening 80.

The punches 100–106 are passed through the respective guide plates 110 and 112 and are carried by plates 114 and 116, respectively.

Figure 7B:
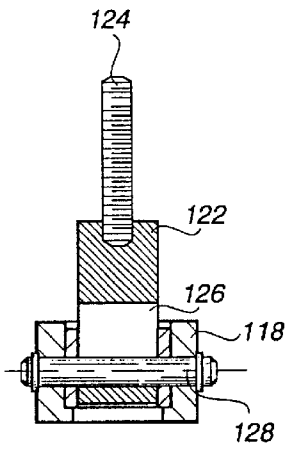
FIG. 7*b* is a section along line VII—VII of FIG. 7*a;*
Figure 7A:
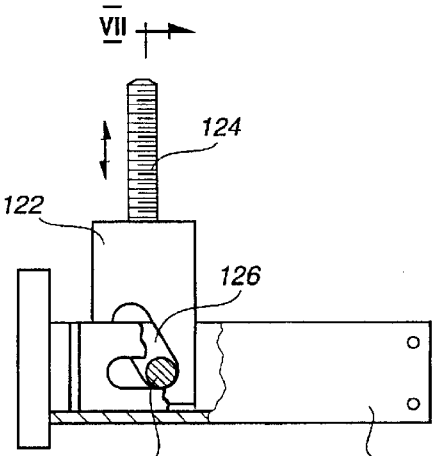
FIG. 7*a* shows a detail of construction for attaining the lateral motion of the side punches of the punching press of FIG. 4.

Concentrating first on the right-hand side of the punching mechanism, it will be seen that plate 114 is coupled to reciprocable double rail member 118 as seen in FIG. 7*b*. An inclined pin-and-slot coupling mechanism is implemented, in the form of block 122 connected by screw thread rod 124 to the reciprocable cross plate 88 (see FIG. 4) and thus reciprocable in unison with the male punch 90. Vertical position adjustments are attained by opposite bolt and nut 124*a* and 124*b*. Block 122 is formed with slot 126 extending at an angle relative to the vertical as shown in FIG. 7*a*. Pin 128 is passed through the slot 126, mounted between the legs of the rail 118, for applying a sidewise or transverse movement (to the left) of the carrier rail 118, the punches carrying plate 114, and thus to punches 100 and 102. Hence, upon downward stroke of the block 122, openings 74 and 76 are perfected.

It will be readily understood that any other, equivalent, cross-wise movement transmission arrangements may be employed, such as cams or link arms, known per-se.

A similar, mirror-image structure is provided at the other, left-hand side of the punching press 82 (with regard to punching of openings 78 and 80), which therefore need not to be described in greater detail.

Figure 8C:
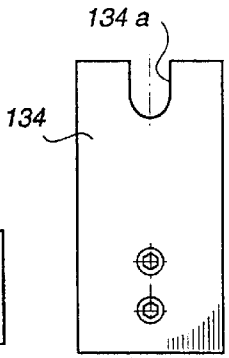
FIG. 8*c* is a view taken in the direction of arrow A in FIG. 8*a;*
Figure 8B:
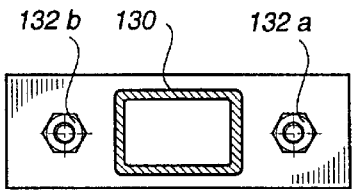
FIG. 8*b* is a sectional view taken along line VIII—VIII of FIG. 8*a;*
Figure 8A:
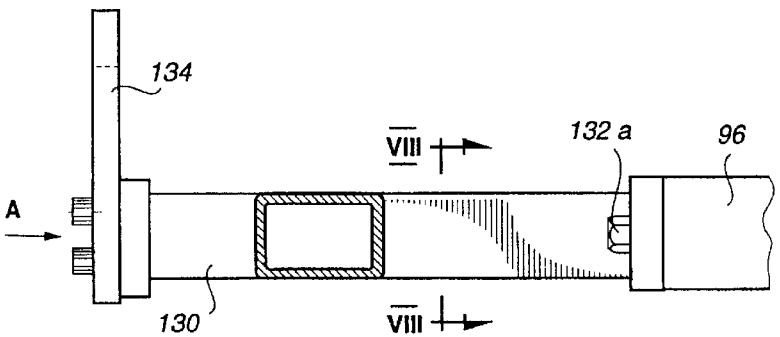
FIG. 8*a* illustrates the mounting of the mandrel rod carrier affixed to base plate of the punching press of FIG. 4.

Turning now to FIGS. 8 and 9, the application of the non-stationary mandrel rod support concept is illustrated. Hence, to the side of base plate 96 (FIG. 4) there is mounted extension bar 130 (of a rectangular cross section as shown), e.g. by a pair of nuts 132*a* and 132*b*. Upright plate 134 is provided with recess 134*a*, similar to the recess 60 in FIG. 2*d*.

Mandrel rod 140 is provided, with recess 142 at its free end, preferably with upright pointing pin 144, and a longitudinally adjustable stop bracket 146 with locking screw 148.

Figure 10A:
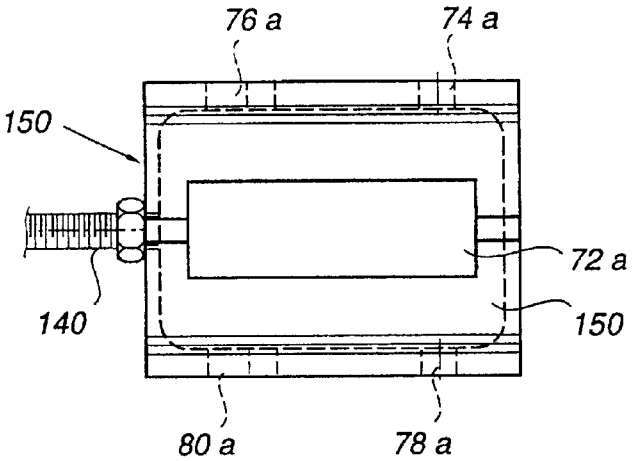
FIG. 10*a* is a top view of the matrix shown in FIG. 9*a;*
Figure 10C:
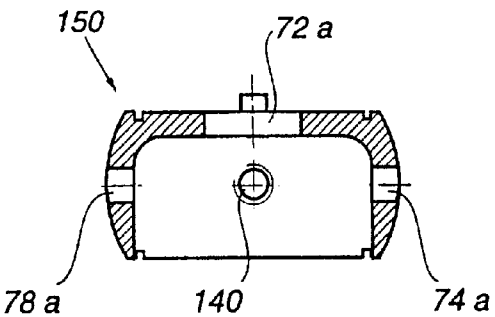
FIG. 10*c* is a section taken along line X—X of FIG. 10*b;*
Figure 10B:
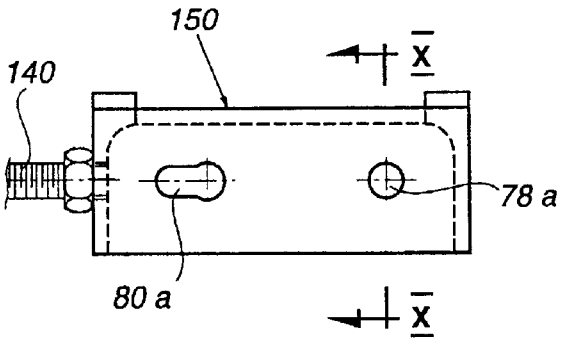
FIG. 10*b* is a side view of the matrix of FIG. 10*a;*

Female matrix 150, details of which are better seen in FIGS. 10*a*–10*c* is carried by the mandrel rod 140. Thus, the matrix 150 is hollow (to facilitate evacuation of stamped-out pieces), and provided with the counter backup punching openings 72*a* through 80*a* conforming the respective openings 72–80 to be punched at the bar 70.

The final operative position is seen in FIG. 11 wherein profile 70 is shown, after insertion thereinto of the matrix 150 in the aligned position as dictated by its length from the recess portion 142 of the mandrel rod 140 and the recess portion 134*a* of the upright plate 134 (see FIG. 8).

Referring now to FIGS. 12–15, it will be readily understood that yet a further unique advantage of the invention is attained, in that the same set of punches (90 and 100, 102, 104 and 106) can be used for processing different shapes of profiled bars.

Figure 12B:
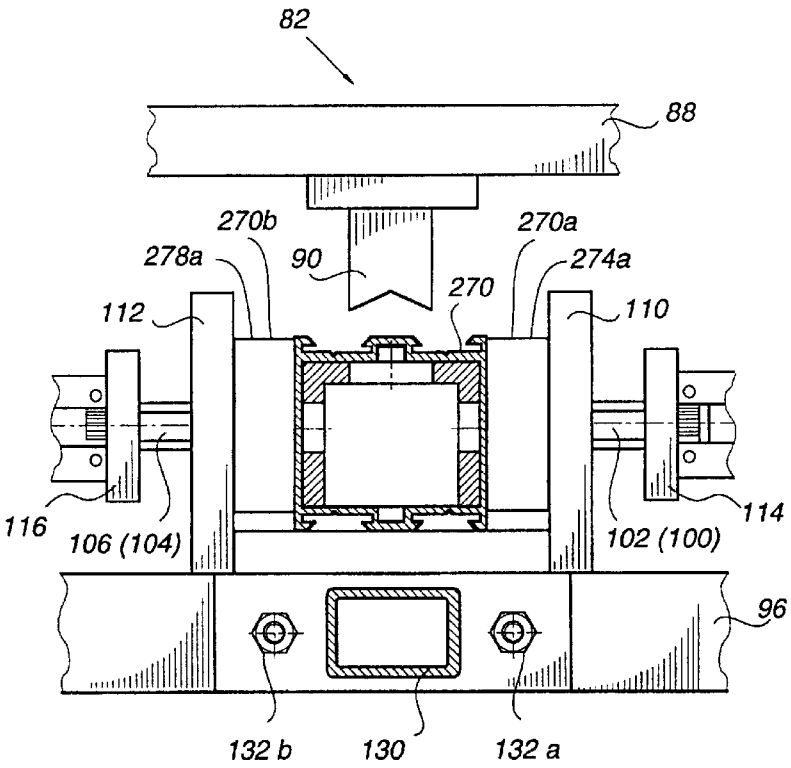
FIG. 12*b* shows the pressing punch set for processing the modified profiled bar of FIG. 12*a;*
Figure 12A:
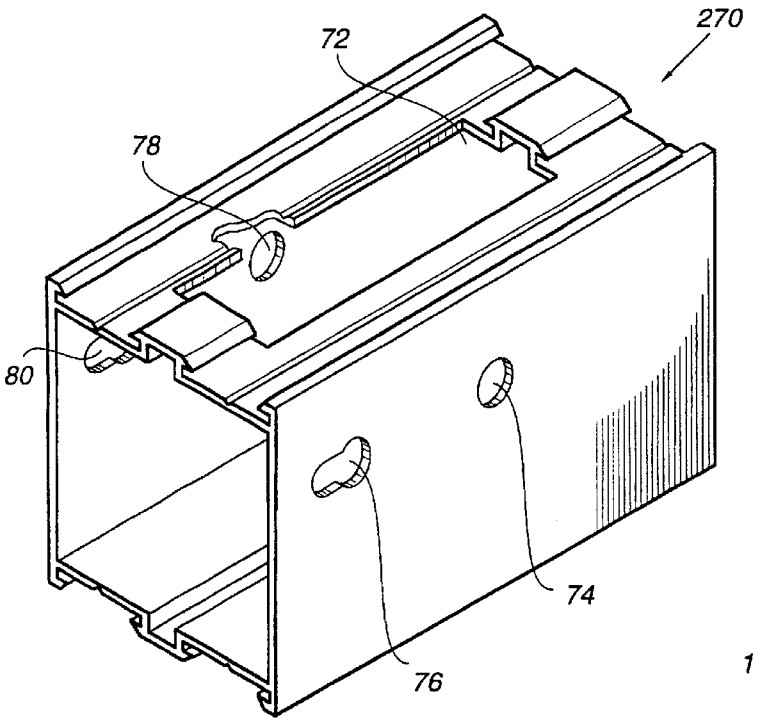
FIG. 12*a* illustrates a modified profiled bar to be processed by the same punching press.
Figure 13B:
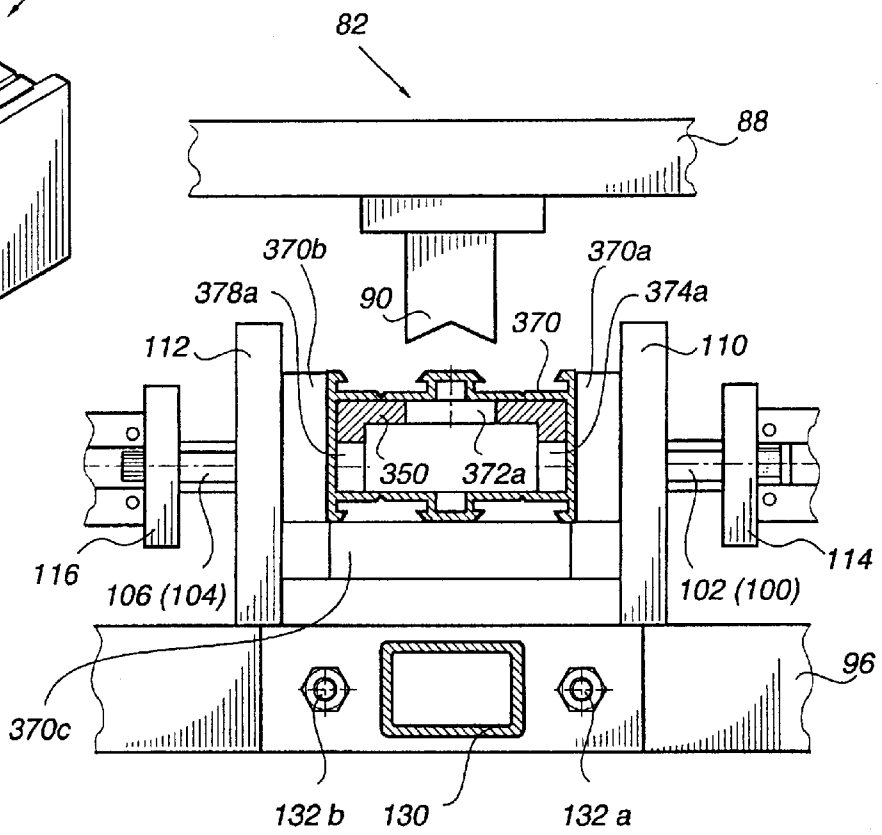
FIGS. 13*a* and 13*b* illustrate the application of the invention to a still further modified profiled bar.
Figure 13A:
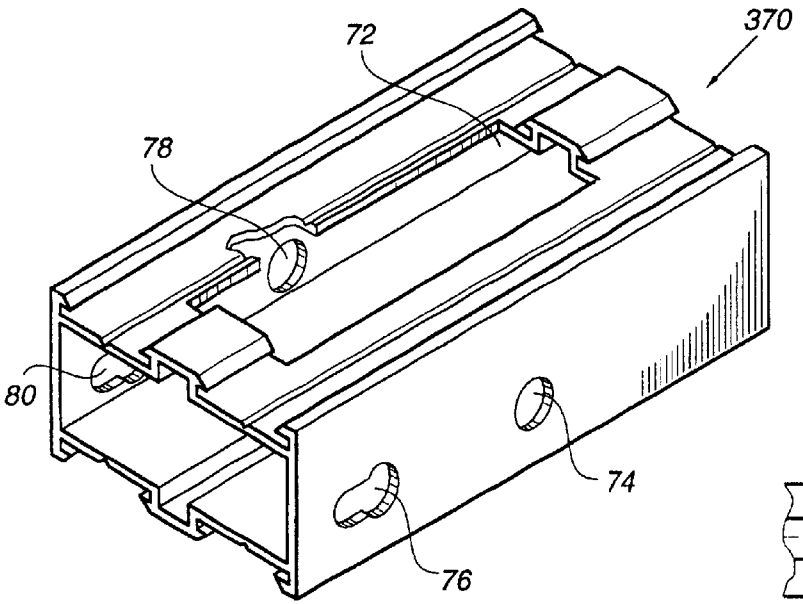
Figure 14B:
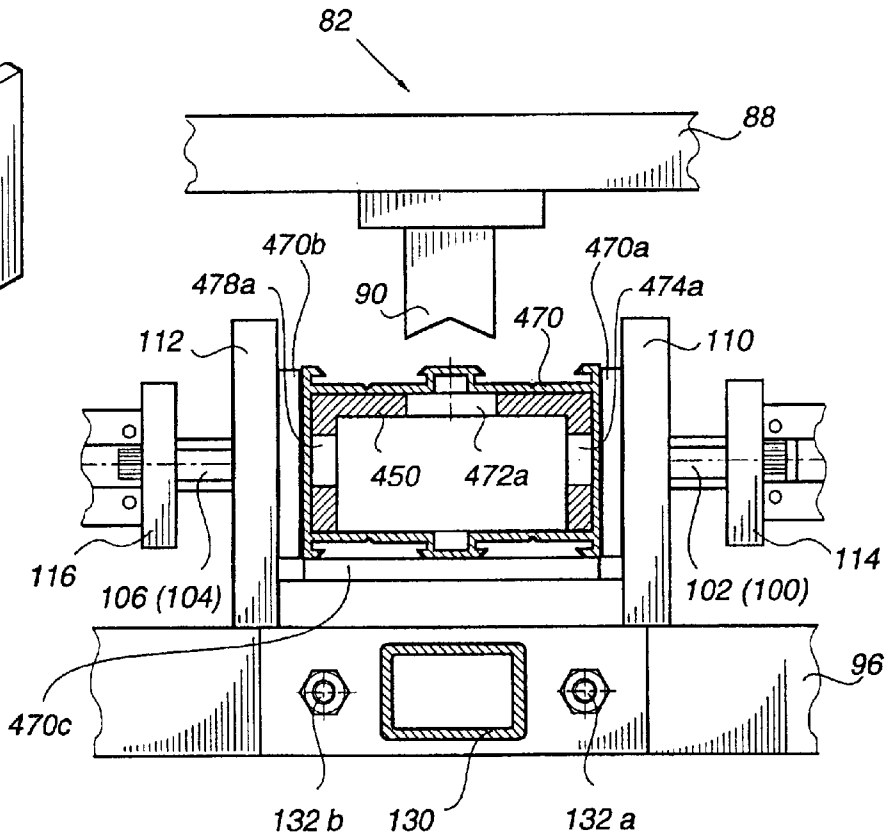
FIGS. 14*a* and 14*b* illustrate the application of the invention to a still further modified profiled bar.
Figure 14A:
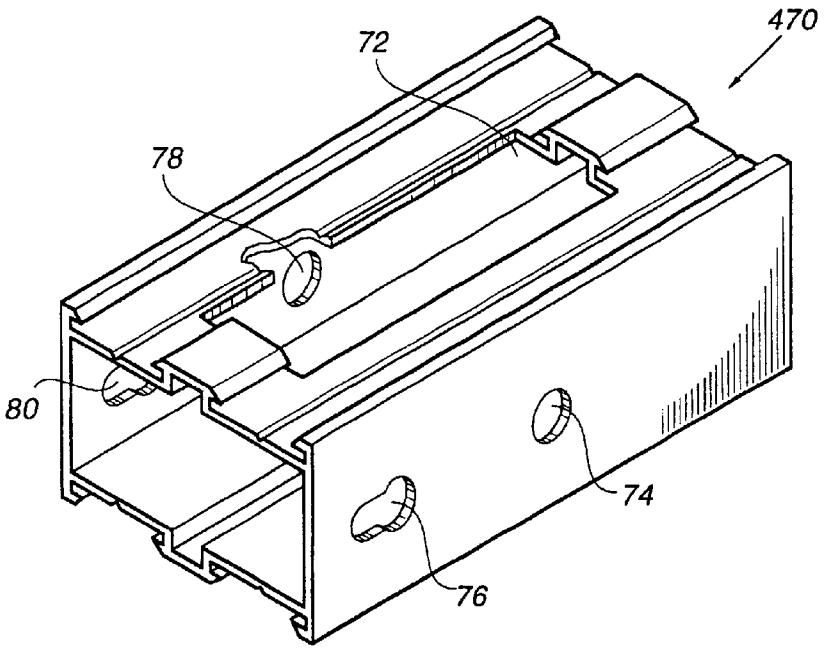

Hence, FIG. 12*a* shows a profiled bar 270 where an identical series of openings 72–80 for cylinder lock system (cf. FIG. 3) is to be punched. FIG. 12*b* shows the relevant portion of the punching press 82 (FIG. 4). The profile 270 is clamped for punching, only this time spacing blocks 270*a* and 270*b* are required to fill-in because of the smaller width of the profiled bar 270.

In a similar manner, profiled bar 370 is processed by the same pressing punch with aid of spacing blocks 370*a*, 370*b* and 370*c*; and profile 470—with blocks 470*a*, 470*b* and 470*c* (see FIGS. 13*a*, 13*b* and 14*a*, 14*b*).

Figure 15B:
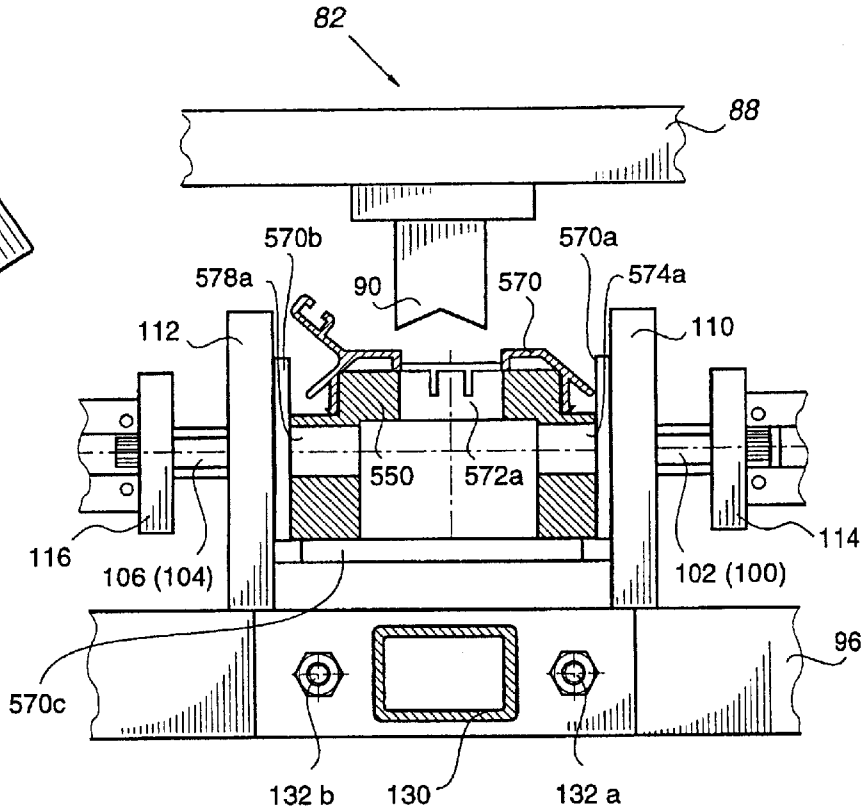
FIGS. 15*a* and 15*b* illustrate the application of the invention to a non-hollow profiled bar.
Figure 15A:
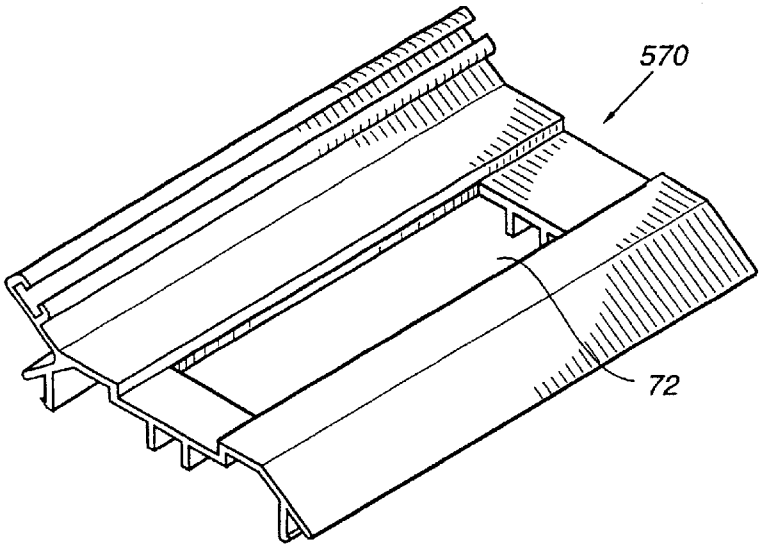

It is sometimes requested to have non-hollow profiled bars punched with the same rectangular opening 72—see FIGS. 15*a*–15*b*. In this case, the replaceable matrix 550 will have to be made with "fictitious" counter-holes 574*a* through 580*a* which take no active part in the punching process.

The advantages derived from the method of punching forming the subject matter of the present invention are clearly evident. The vis-a-vis, in register location of the side walls opening is ensured by the very structure of the punching press and assemblies, and the same applies to the relative location of the top rectangular opening 72*a*. The process is by far more accurate and speedy due to the implementation of the non-stationary mandrel rod concept as explained and exemplified above.

Moreover, as already mentioned, should it be desired to apply a pair of oppositely located openings which are both off-centered relative to the axis of symmetry of the processed bar, only one and single press device is required, operable with a single, non-stationary matrix and mandrel rod as proposed by the present invention.

All that is requested are means for placing the matrix (and rod) at two, parallel, transversely distanced locations (conforming to twice the distance between the center of the opening and the bar's axis of symmetry). This will enable to punch the first opening in the usual manner as described above, and then the second opening, by merely mounting the profiled bar on the matrix in an inverted position, and carrying on the second punch at the said distanced location of the matrix/bar assembly.

While the above description contains many specificities, these should not be construed as limitations on the scope of the invention, but rather as exemplification of the preferred embodiments. Those skilled in the art will envision other possible variations that are within its scope. Accordingly, the scope of the invention should be determined not by the embodiment illustrated, but by the appended claims.

What is claimed is:

1. A punching press device for punching openings in profiled bars comprising a base structure, a male punch, a female punching matrix for backing the bars during the punching operation, an elongated mandrel rod having a first end mountable to the base structure and a second end carrying the backing bar;

a releasable mounting means for releasably mounting the first end of the mandrel rod to the base structure, wherein the rod is removable from the base structure;

adjustable distance setting means being mountable to the rod for setting the distance between the end of the bar and the punched opening.

2. The device as claimed in claim 1 wherein the setting means comprise a stop bracket.

3. The device as claimed in claim 1 wherein the releasable mounting means for releasably mounting the first end of the rod is comprises a slot formed in the rod and a slot formed in an extension member of the base structure.

4. The device as claimed in claim 1 wherein the punching press device comprise at least two male punches for enabling the punching of openings at at least two sides of the profiled bar.

5. The device as claimed in claim 1 further comprising a pair of side male punches laterally operated by a vertically reciprocal cross plate, the reciprocal cross plate being coupled to the laterally reciprocating side punches by a motion transfer mechanism comprising fixed pins sliding in slots, said slots being inclined to the vertical.

6. A method of punching openings in profiled bars by a punching press device comprising a base structure, a male punch and a female punching matrix comprising the steps of:

mounting the female punching matrix to an elongated rod;

inserting the matrix and a portion of the rod into the profiled bar down a preset distance by using setting means;

releasably attaching the rod/matrix/bar assembly to a fixed portion of the base structure so that the matrix becomes located in an appropriate operative position in relation to the male punch;

punching the opening by the opening by the male punch;

removing the rod/matrix/bar assembly from the press device; and removing the bar from the matrix.

7. The method as claimed in claim 6 wherein a pair of opposite, off-centrally located openings are to be formed at opposite walls of the bar in register one with respect to the other, the method comprising the steps of forming the first opening, inverting the position of the bar on the matrix and placing the matrix/bar assembly in a second, parallel distanced position suitable for punching the second opening by the male punch.

8. The method as claimed in claim 6 wherein the at least one opening of the same pattern are punched on different ones of the profiled bars, for each bar a suitable female matrix is being used, the method further comprising providing at least one distancing block at the sides and/or the bottom of the profile bar to fill-in smaller measurements thereof.

* * * * *